US009214127B2

(12) United States Patent
Jamshidi-Roudbari et al.

(10) Patent No.: US 9,214,127 B2
(45) Date of Patent: Dec. 15, 2015

(54) LIQUID CRYSTAL DISPLAY USING DEPLETION-MODE TRANSISTORS

(71) Applicant: APPLE INC., Cupertino, CA (US)

(72) Inventors: Abbas Jamshidi-Roudbari, Sunnyvale, CA (US); Cheng-Ho Yu, Cupertino, CA (US); Hopil Bae, Sunnyvale, CA (US); Shih Chang Chang, Cupertino, CA (US); Ting-Kuo Chang, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 141 days.

(21) Appl. No.: 13/937,825

(22) Filed: Jul. 9, 2013

(65) Prior Publication Data

US 2015/0015559 A1 Jan. 15, 2015

(51) Int. Cl.
*G09G 5/00* (2006.01)
*G09G 3/36* (2006.01)

(52) U.S. Cl.
CPC ..... *G09G 3/3696* (2013.01)

(58) Field of Classification Search
CPC ..... G09G 3/3696
USPC ..... 345/90, 103, 204–215, 690; 257/48; 315/169.1; 349/38
See application file for complete search history.

(56) References Cited

U.S. PATENT DOCUMENTS 4,808,983 A * 2/1989 Benjamin et al. ..... 345/90
5,510,807 A * 4/1996 Lee et al. ..... 345/103
5,798,524 A * 8/1998 Kundmann et al. ..... 250/305
5,801,673 A * 9/1998 Shimada et al. ..... 345/100
6,639,590 B2 * 10/2003 Takahashi et al. ..... 345/211
6,894,445 B2 * 5/2005 Allender ..... 315/382
7,109,965 B1 9/2006 Lee et al.
7,710,412 B2 * 5/2010 Adachi et al. ..... 345/206
9,000,796 B2 * 4/2015 Shirouzu ..... 324/760.02
2002/0196223 A1 * 12/2002 Takahashi et al. ..... 345/90
2003/0231156 A1 * 12/2003 Takeuchi et al. ..... 345/98
2004/0257147 A1 12/2004 Jeoung et al.
2006/0012587 A1 * 1/2006 Stevenson et al. ..... 345/204
2006/0077918 A1 * 4/2006 Mao et al. ..... 370/310
2006/0082563 A1 * 4/2006 Nishioka et al. ..... 345/204
2008/0029762 A1 * 2/2008 Schroeder et al. ..... 257/48
2008/0129212 A1 * 6/2008 Chen et al. ..... 315/169.1
2008/0136983 A1 * 6/2008 Huang ..... 349/38
2009/0073157 A1 * 3/2009 Lin ..... 345/212
2009/0295423 A1 * 12/2009 Levey ..... 324/769
2010/0097365 A1 4/2010 Fang et al.

(Continued)

OTHER PUBLICATIONS

Perlmutter et al.; "Depredation of Liquid Crystal Device Performance due to Selective Adsorption of Ions," Appl. Phys Lett., vol. 69, No. 9, Aug. 26, 1996, pp. 1182-1184.

*Primary Examiner* — Prabodh M Dharia
(74) *Attorney, Agent, or Firm* — Fletcher Yoder PC

(57) ABSTRACT

Methods and devices employing charge removal circuitry are provided to reduce or eliminate artifacts due to a bias voltage remaining on an electronic display after the display is turned off. In one example, a method may include connecting a pixel electrode of a display to ground through charge removal circuitry while the display is off (e.g., using depletion-mode transistors that are active when gates of the depletion-mode transistors are provided a ground voltage). When a corresponding common electrode is also connected to ground, a voltage difference between the pixel electrode and common electrode may be reduced or eliminated, preventing a bias voltage from causing display artifacts in the pixel.

23 Claims, 8 Drawing Sheets

(56) References Cited

U.S. PATENT DOCUMENTS

| | | | | |
|---|---|---|---|---|
| 2010/0156868 | A1 | 6/2010 | Hirayama | |
| 2010/0163874 | A1* | 7/2010 | Koyama et al. | 257/57 |
| 2010/0244031 | A1* | 9/2010 | Akimoto et al. | 257/57 |
| 2012/0075260 | A1* | 3/2012 | Saito et al. | 345/204 |
| 2012/0280725 | A1* | 11/2012 | Koyama et al. | 327/109 |
| 2012/0299970 | A1* | 11/2012 | Bae et al. | 345/690 |
| 2012/0299972 | A1* | 11/2012 | Bae | 345/690 |
| 2013/0076721 | A1* | 3/2013 | Al-Dahle | 345/212 |
| 2013/0082994 | A1 | 4/2013 | Al-Dahle | |
| 2013/0328847 | A1* | 12/2013 | Al-Dahle et al. | 345/211 |
| 2013/0342522 | A1* | 12/2013 | Hagood et al. | 345/212 |

* cited by examiner

LIQUID CRYSTAL DISPLAY USING DEPLETION-MODE TRANSISTORS

BACKGROUND

The present disclosure relates generally to electronic displays and, more particularly, to liquid crystal displays (LCDs) that may be turned off in a manner that reduces or eliminates visual artifacts.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and phones. LCDs portray images by modulating an amount of light that passes through a liquid crystal layer within pixels of varying color. For example, by varying a voltage difference between a pixel electrode and a common electrode in a pixel, an electric field may result. The electric field may cause the liquid crystal layer to vary its alignment, which may ultimately result in more or less light being emitted through the pixel where it may be seen. By changing the voltage difference (often referred to as a data signal) supplied to each pixel, images may be produced on the LCD.

To store data representing a particular amount of light that is to be passed through pixels, gates of thin-film transistors (TFTs) in the pixels may be activated while the data signal is supplied to the pixels. Conventionally, when an LCD is turned off, the pixel electrodes of all pixels of the LCD may be supplied a minimal voltage. When the TFT gates are deactivated, a kickback voltage may alter the voltage stored in the pixels. The resulting voltage may be different from the supplied minimal voltage and may cause an electric field that remains in place after the LCD is turned off. This electric field may continue to impact the liquid crystal layer of the pixels of the LCD while the LCD is off. It is believed that this electric field caused by the voltage on the pixel electrodes may result in image artifacts, such as flickering or horizontal/vertical lines, that could appear after the display is turned on again.

Moreover, a liquid crystal cell may contain a liquid crystal mixture (e.g., FLC mixture SCE13 in a ferroelectric liquid crystal display) that contains liquid crystals as well as ions. The ions may be classified as "fast-moving" ions and "slow-moving" ions. The fast-moving ions move quickly within the liquid crystal layer upon application of a voltage across the liquid crystal layer. Similarly, the slow-moving ions move slowly when a voltage is applied across the liquid crystal layer. The fast-moving ions typically can move around within the liquid crystal freely, but the slow-moving ions tend to move significant distance when a charge remains across the liquid crystal layer over a period of time. For example, a voltage difference may remain across the liquid crystal layer when the LCD is turned off and a kickback voltage creates a voltage difference between a pixel electrode and common electrode across the liquid crystal layer. After some period of time, the slow-moving ions may move to form one or more sheets of ions that may create electric fields that result in a voltage bias that interferes with the intended behavior of the liquid crystal layer. Although it may be desirable to not include slow-moving ions, it may be impossible or impractical to remove all slow-moving ions from the liquid crystal mixture.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for reducing or removing a voltage (e.g., causing an electric field) across a liquid crystal cell of a display when the display is turned off regardless of whether a kickback voltage occurs. By way of example, a method for reducing the voltage may include shorting pixel electrodes to ground via circuitry (e.g, multiple use circuitry that may also be used to test display panel viability) utilizing depletion-mode transistors that are switched on—that is, act as a closed switch—when no voltage is applied to the gate. In other words, the depletion-mode transistors enable a connection between the pixel electrodes and ground when the display is turned off. Accordingly, the pixel electrodes have a voltage substantially equal to the ground voltage (e.g., 0V). The pixel electrodes are coupled to one terminal of a liquid crystal cell while the other terminal (e.g., common electrode) is coupled to a Vcom. The Vcom may also be held to ground by a source driver and/or Vcom source. Accordingly, opposite terminals of the liquid crystal cell may have substantially the same voltage. Since no substantial voltage is occurs across the liquid crystal cell when the display is off, no substantial voltage may be present to cause the formation of a voltage bias in the liquid crystal cell due to slow moving ions that may cause visual artifacts (e.g., flickers or mura artifacts) when the display is turned back on.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
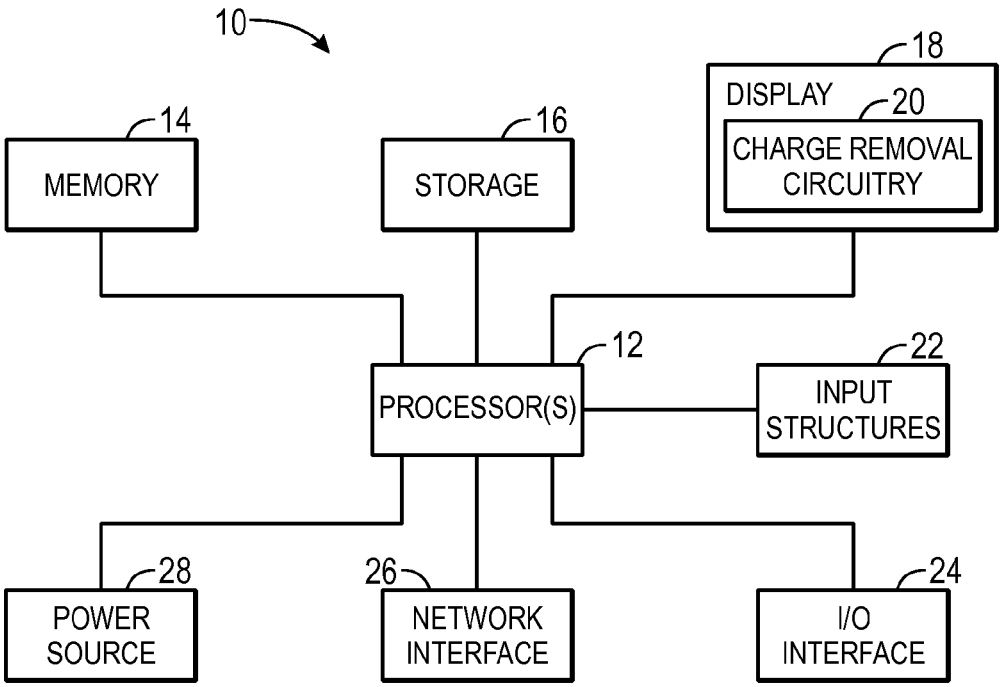
FIG. 1 is a schematic block diagram of an electronic device with a liquid crystal display (LCD) having charge removal circuitry, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, embodiments of the present disclosure relate to liquid crystal displays (LCDs) and electronic devices incorporating LCDs having charge removal circuitry that may be used to reduce or eliminate a voltage difference across liquid crystal cells when the display is turned off. Specifically, the testing circuit may be used to short pixel nodes together via data lines. The testing circuitry may also be used to short the data lines together at ground. Accordingly, the pixel electrode of each pixel may be held at ground (e.g., 0V) via the charge removal circuitry when the display is turned off. Furthermore, because a source driver and/or Vcom source may hold a Vcom (e.g., common electrode) for the pixel substantially at ground (e.g., ≈0V) when the display is off, the Vcom and the pixel electrode may be substantially the same voltage when the display is off regardless of the initial presence of a kickback voltage upon shutdown of the display. In fact, the reduced amount of residual voltage remaining on the pixels substantially reduce the effect of any image artifacts that might otherwise form from a voltage bias created by a voltage remaining across the liquid crystal cells when the display is turned off.

Specifically, to decrease the amount of residual voltage remaining on the pixels, a Vcom ground may be substantially the same as the ground to which the pixel electrodes are held via the testing circuitry. As a result, the voltage at either end of the liquid crystal cell is substantially the same, and a residual voltage may be less likely to appear on the liquid crystal after the LCD is turned off. By reducing the likelihood of a residual voltage, the likelihood of image artifacts due to a formation of a voltage bias in the liquid crystal may be reduced when the LCD is turned back on.

Figure 2:
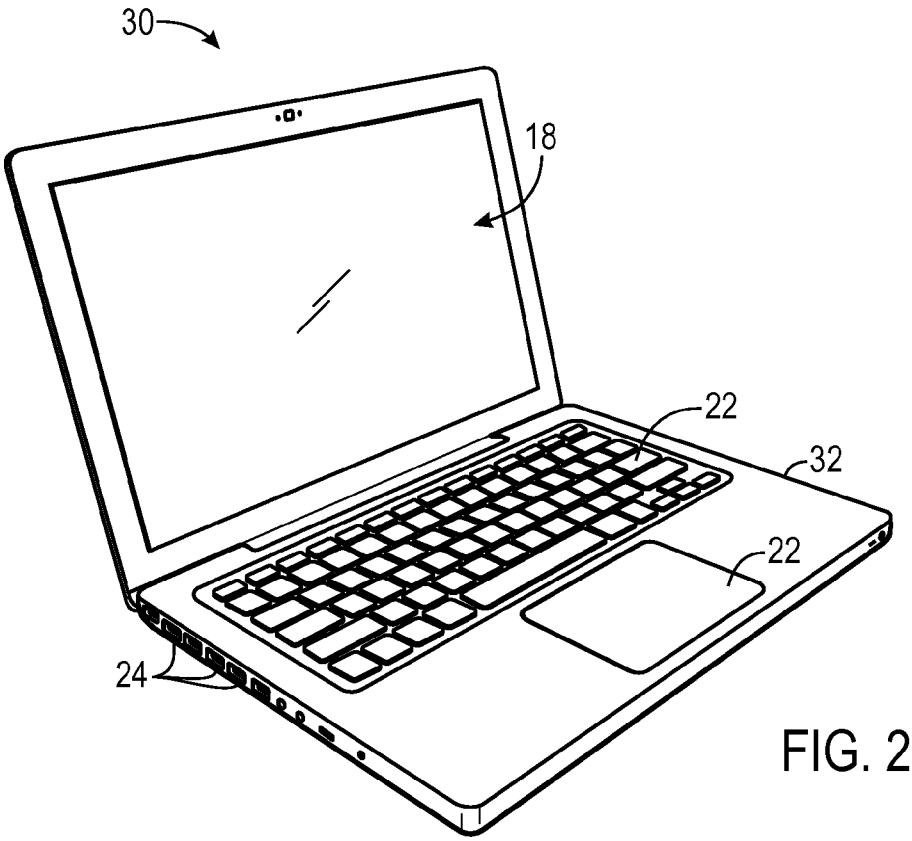
FIG. 2 is a perspective view of a notebook computer representing the electronic device of FIG. 1, in accordance with an embodiment.
Figure 3:
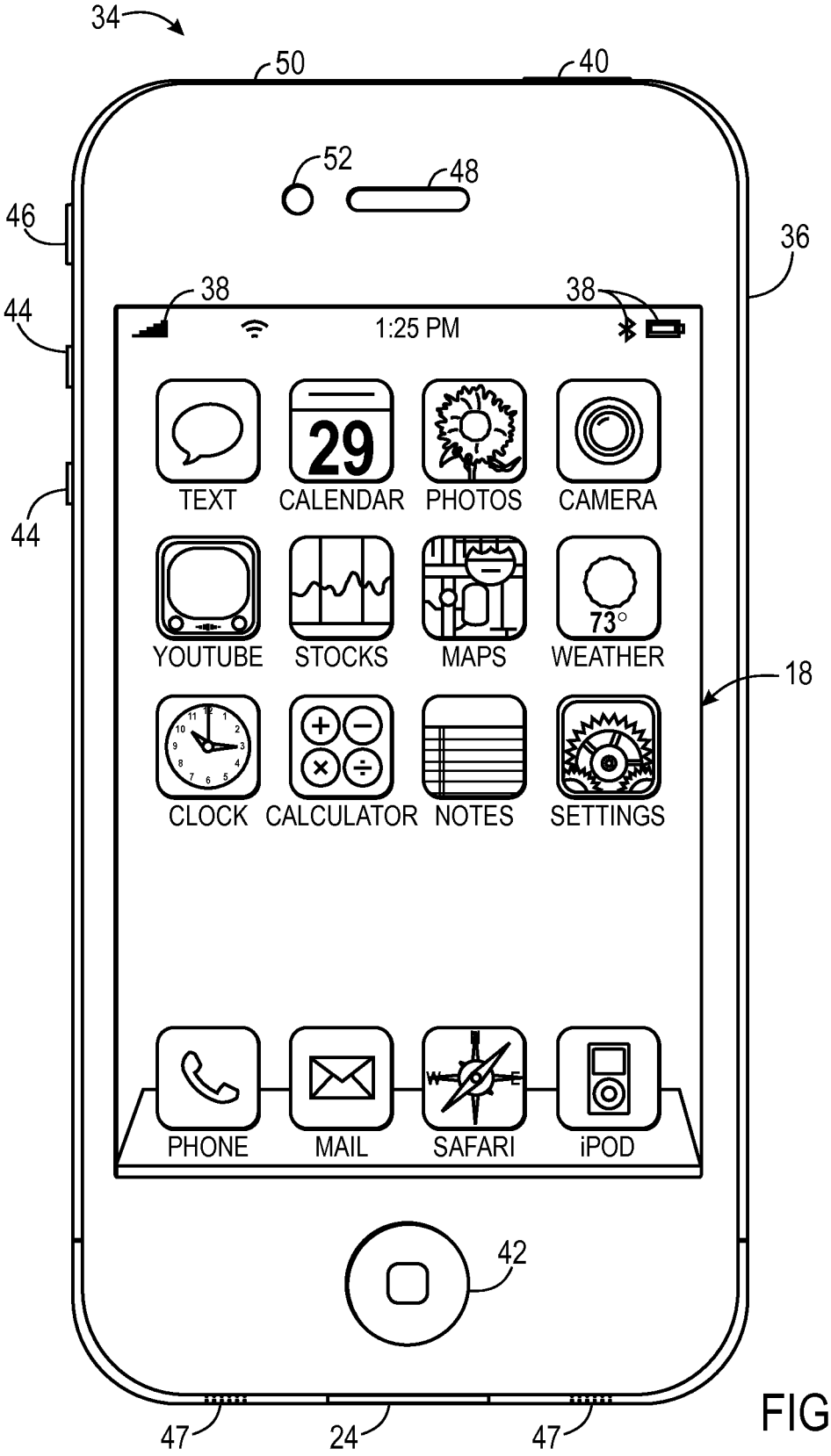
FIG. 3 is a front view of a handheld device representing the electronic device of FIG. 1, in accordance with an embodiment.

With the foregoing in mind, a general description of suitable electronic devices that may employ electronic displays having charge removal circuitry will be provided below. In particular, FIG. 1 is a block diagram depicting various components that may be present in an electronic device suitable for use with such a display. FIGS. 2 and 3 respectively illustrate perspective and front views of a suitable electronic device, which may be, as illustrated, a notebook computer or a handheld electronic device.

Turning first to FIG. 1, an electronic device 10 according to an embodiment of the present disclosure may include, among other things, one or more processor(s) 12, memory 14, nonvolatile storage 16, a display 18 having charge removal circuitry 20, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10. As presented herein, the data processing circuitry may control the electronic display 18 by determining when the electronic display 18 is to be turned off and by issuing a turn-off or shutdown command. The turn-off or shutdown command is provided to the display 18, which uses the charge removal circuitry 20 to at least partially remove a charge across the liquid crystal cell thereby reducing the occurrence of image artifacts when the display 18 is later turned back on.

In the electronic device 10 of FIG. 1, the processor(s) 12 and/or other data processing circuitry may be operably coupled with the memory 14 and the nonvolatile memory 16 to execute instructions. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12.

The display 18 may be a touch-screen liquid crystal display (LCD), for example, which may enable users to interact with a user interface of the electronic device 10. In some embodiments, the electronic display 18 may be a MultiTouch™ display that can detect multiple touches at once. As will be described further below, charge removal circuitry 20 within the display 18 may substantially remove a charge across a liquid crystal cell of the display 18. In some embodiments, the charge removal circuitry 20 may be included in or be supplementary to testing circuitry located within the display 18 that may be used to test the display 18 during manufacture. The charge removal circuitry 20 may couple each pixel electrode to ground when the display 18 is turned off using depletion-mode transistors that enable current to flow when the transistor is not powered (e.g., when the display 18 is off).

By connecting each pixel electrode to ground, any kick-back voltage present on each pixel electrode after the display 18 is turned off may be dissipated/distributed to ground. Further, opposite terminals of the liquid crystal cell are coupled to the pixel electrode and a Vcom terminal electrode (e.g., common electrode). The Vcom terminal is also held at ground via a Vcom source, which may or may not continue to connect to a ground source after the display 18 is turned off. Accordingly, at least at the time the display 18 is turned off, the voltage of both terminals of each liquid crystal cell is approximately the same (e.g., ≈0V), thereby reducing and/or removing an electric field applied across the liquid crystal cell when the display 18 is turned off. By removing or reducing the electric field while the display 18 is off, the charge removal circuitry 20 reduces the probability of display artifacts resulting from a voltage bias formed in the liquid crystal due to a prolonged exposure to an electric field while the display 18 is off.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on the display 18. Further, the display 18 may include the charge removal circuitry 20.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 47 may obtain a user's voice for various voice-related features, and a speaker 50 may enable audio playback and/or certain phone capabilities. A headphone input 52 may provide a connection to external speakers and/or headphones. As mentioned above, the display 18 may include the charge removal circuitry 20.

Figure 4:
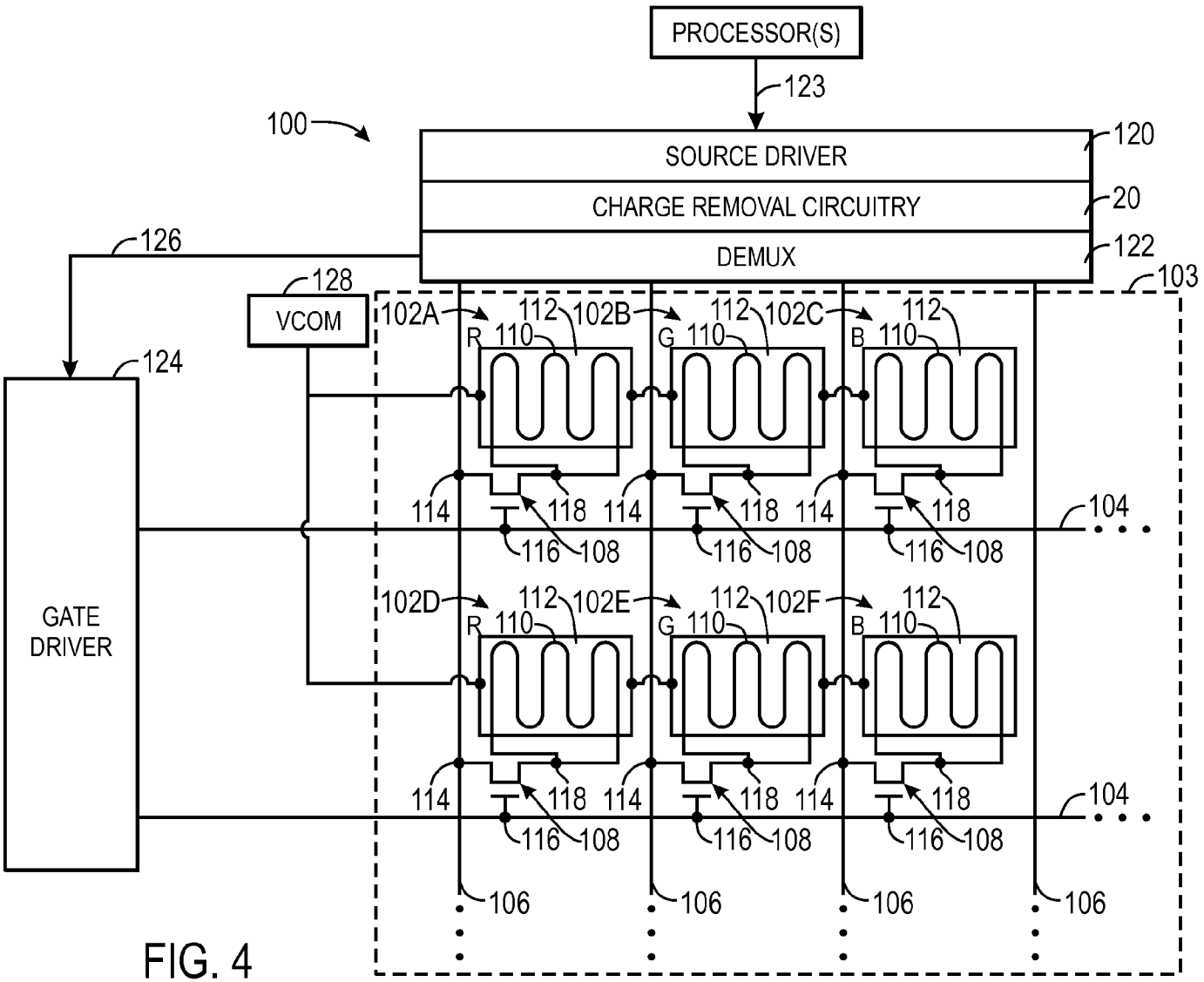
FIG. 4 is a circuit diagram illustrating charge removal circuitry used to reduce a voltage across a liquid crystal, in accordance with an embodiment.

Among the various components of an electronic display 18 may be a pixel array 100, as shown in FIG. 4. FIG. 4 generally represents a circuit diagram of certain components of the display 18 in accordance with an embodiment. In particular, the pixel array 100 of the display 18 may include a number of unit pixels 102 disposed in an active area 103 of a pixel array 100. The active area 103 may include circuitry used to display images and/or receive touch gestures. In such an array, each unit pixel 102 may be defined by the intersection of rows and columns, represented by gate lines 104 (also referred to as scanning lines), and source lines 106 (also referred to as data lines), respectively. Although only six unit pixels 102, referred to individually by the reference numbers 102A-102F, respectively, are shown for purposes of simplicity, it should be understood that in an actual implementation, each source line 106 and gate line 104 may include hundreds or thousands of such unit pixels 102. Each of the unit pixels 102 may represent one of three subpixels that respectively filters only one color (e.g., red, blue, or green) of light. For purposes of the present disclosure, the terms "pixel," "subpixel," and "unit pixel" may be used largely interchangeably.

In the presently illustrated embodiment, each unit pixel 102 includes a thin film transistor (TFT) 108 for switching a data signal supplied to a respective pixel electrode 110. The potential stored on the pixel electrode 110 relative to a potential of a common electrode 112, which may be shared by other pixels 102, may generate an electrical field sufficient to alter the arrangement of a liquid crystal layer of the display 18. In the depicted embodiment of FIG. 4, a source 114 of each TFT 108 may be electrically connected to a source line 106 and a gate 116 of each TFT 108 may be electrically connected to a gate line 104. A drain 118 of each TFT 108 may be electrically connected to a respective pixel electrode 110. Each TFT 108 may serve as a switching element that may be activated and deactivated (e.g., turned on and off) for a period of time based on the respective presence or absence of a scanning or activation signal on the gate lines 104 that are applied to the gates 116 of the TFTs 108.

When activated, a TFT 108 may store the image signals received via the respective source line 106 as a charge upon its corresponding pixel electrode 110. As noted above, the image signals stored by the pixel electrode 110 may be used to generate an electrical field between the respective pixel electrode 110 and a common electrode 112. This electrical field may align the liquid crystal molecules within the liquid crystal layer to modulate light transmission through the pixel 102. Thus, as the electrical field changes, the amount of light passing through the pixel 102 may increase or decrease. In general, light may pass through the unit pixel 102 at an intensity corresponding to the applied voltage from the source line 106.

The display 18 also may include a source driver integrated circuit (IC) 120, which may include a chip, such as a processor, microcontroller, or application specific integrated circuit (ASIC), that controls the display pixel array 100. During normal operation, the source driver IC 120 connects directly to demultiplexer circuitry 122. The source driver IC 120 receives image data 123 (e.g., red-green-blue (RGB) image data) from the processor(s) 12 and sends the image data 123 to the demultiplexer circuitry 122. The demultiplexer circuitry 122 demultiplexes the image data 123 into component pixel image data (e.g., red, green, and blue pixel image data) and sends the image data 123 to the appropriate pixels 102 (e.g., 102A, 102B, and 102C). The source driver IC 120 may be a chip-on-glass (COG) component on a TFT glass substrate, a component of a display flexible printed circuit (FPC), and/or a component of a printed circuit board (PCB) that is connected to the TFT glass substrate via the display FPC. Further, the source driver IC 120 may include any suitable article of manufacture having one or more tangible, computer-readable media for storing instructions that may be executed by the source driver IC 120.

The source driver IC 120 also may couple to a gate driver integrated circuit (IC) 124 that may activate or deactivate rows of unit pixels 102 via the gate lines 104. As such, the source driver IC 120 may provide timing signals 126 to the gate driver 124 to facilitate the activation and deactivation of individual rows (i.e., lines) of pixels 102. In other embodiments, timing information may be provided to the gate driver 124 in any other suitable manner. The display 18 may include a Vcom source 128 to provide a Vcom output to the common electrodes 112. In some embodiments, the Vcom source 128 may supply a different Vcom to different common electrodes 112 at different times. In other embodiments, the common electrodes 112 all may be maintained at the same potential (e.g., a ground potential) while the display 18 is on.

During operation, a kickback voltage may occur when an activation signal is removed by the gate driver 124. That is, when the activation signal is removed, the voltage stored by the pixel electrode 110 may change by an amount substantially equal to the kickback voltage. When the display 18 is turned off, a very low voltage or ground potential may be applied to the pixel electrodes 110. Doing so may minimize the voltage difference biasing the liquid crystal between the pixel electrodes 110 and the common electrodes 112. If a kickback voltage occurs as the display 18 is being shut off, the originally applied voltage could change by the kickback voltage amount, leaving a non-zero bias voltage on the pixel electrodes 110. It is believed that this bias voltage caused by the kickback voltage could affect the liquid crystal by exposing the liquid crystal layer to an electric field over a period of time, creating image artifacts on the display 18 for a long time (e.g., a mura artifact lasting several minutes, hours, days, or even substantially permanently) after the display 18 is turned back on.

To mitigate the effect of the kickback voltage on the pixels 102 when the display 18 is turned off, the charge removal circuitry 20 may remove accumulated charge on the pixels 102 with depletion-mode transistors that are activated when supplied a ground voltage. As seen in a view of the pixel array 100 shown in FIG. 5, the charge removal circuitry 20 may include odd charge removal circuitry (ODD) 130 and even charge removal circuitry (EVEN) 132. Using odd and even charge removal circuitry 130 and 132 may reduce the impedance to discharge the pixels 102, but more or fewer of these connections may be used. The odd charge removal circuitry 130 may couple to a ground line 134 supplied with a ground voltage by an odd ground supply 136. The even charge removal circuitry 132 may couple to a ground line 138 supplied with a ground voltage by an even ground supply 140. The odd and even charge removal circuitry 130 and 132 each may employ a depletion-mode transistor 142 that is on (i.e., conductive) when supplied at least with a ground voltage. During normal operation, a charge removal gate line 144 receives a voltage from a gate line voltage supply (VGL) 146 that is low enough to keep the depletion-mode transistors 142 off (i.e., nonconductive). Yet as will be discussed further below, when the display 18 is turned off, the gate line voltage supply 146 supplies a voltage of ground voltage or higher, switching on the depletion-mode transistors 142 and connecting the demultiplexers 122—and by extension the pixels 102—to ground, allowing the pixels to discharge.

Figure 5:
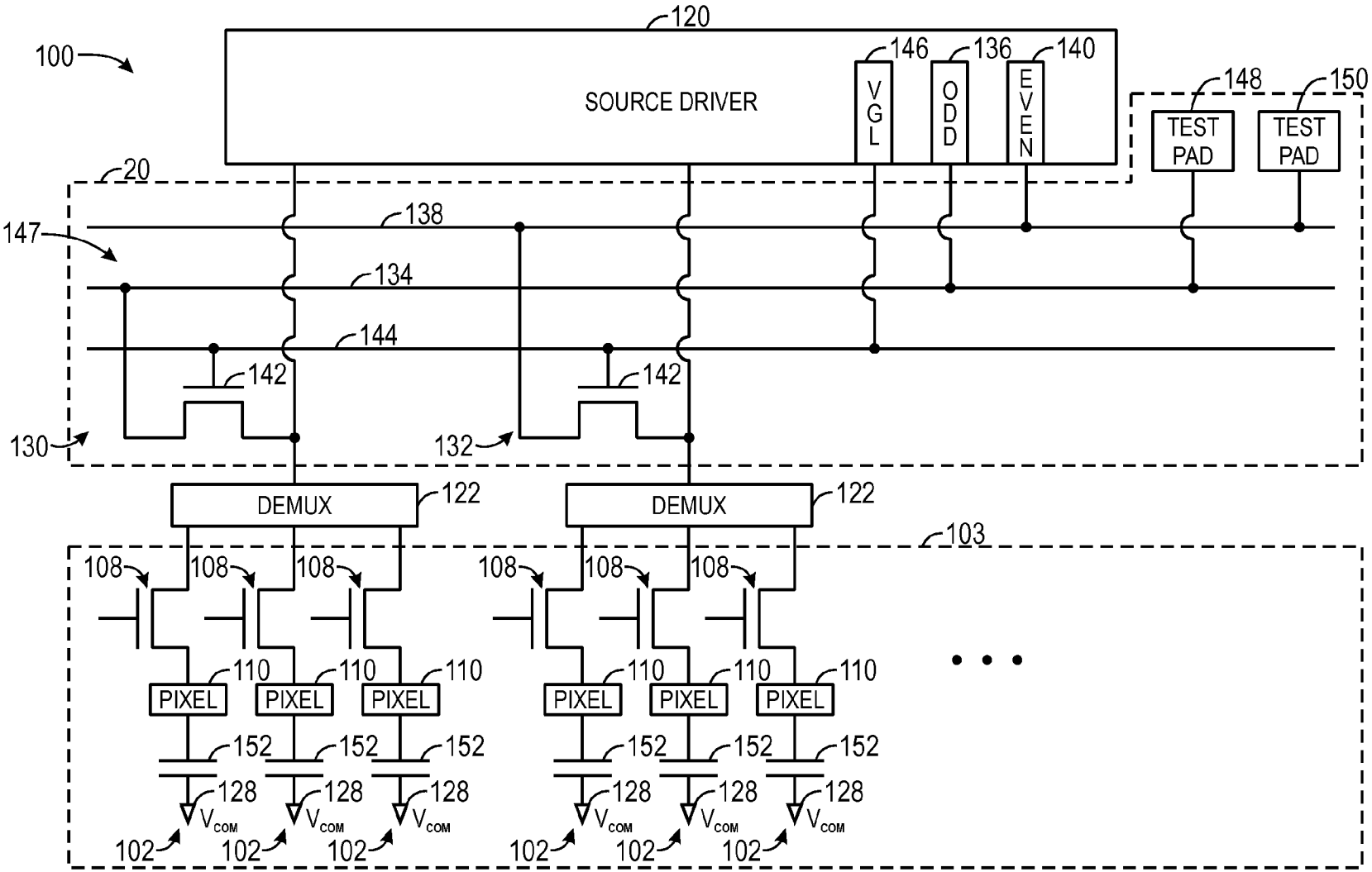
FIG. 5 is a circuit diagram illustrating the charge removal circuitry of FIG. 4, in accordance with an embodiment.

In some embodiments, the charge removal circuitry 20 discussed above may be repurposed from autoprobe (AP) testing circuitry that is used to test the pixel array 100 during the manufacture of the display 18. This is illustrated in FIG. 5 as multiple-use circuitry 147. Specifically, in some embodiments, the pixel array 100 may reuse test circuitry that includes one or more test pads 148 and 150, which enable the pixel array 100 to be tested via the multiple-use circuitry 147. For example, in certain embodiments, the test pads 148 and 150 may be used to perform an autoprobe (AP) test on the pixel array 100. The test pads 148 and/or 150 may be used to AP test lines and/or columns of the pixel array 100 before attaching a liquid crystal layer and/or the source driver IC 120 to the pixel array 100. In other words, the test pads 148 and/or 150 may be used to evaluate the quality of the pixel array 100 during manufacture before coupling the source driver IC 120 to the pixel array 100. Thus, the source driver IC 120 may be coupled only after a pixel array 100 is deemed satisfactory to avoid wasting the source driver IC 120 on an unsatisfactory display panel. In other embodiments, however, the charge removal circuitry 20 may be distinct from any testing circuitry of the display 18.

To enable the charge removal circuitry 20 of the display 18 to discharge kickback voltage on the pixels 102 when the display 18 is turned off, the individual pixel TFTs 108 are also depletion-mode transistors and the demultiplexer circuitry 122 may connect to all pixels when not operating (e.g., the demultiplexer circuitry 122 may also be formed using depletion-mode transistors). In the example of FIG. 5, a pixel capacitance 152 is formed between the pixel electrode 110 and the common voltage (Vcom) 128. When the display 18 is turned off, the charge on the pixel capacitance 152 may be discharged through the TFTs 108. Being depletion-mode transistors, the TFTs 108 connect the pixel capacitance 152 to ground via the demultiplexer circuitry 122 and the odd and/or even charge removal circuitry 130 and 132.

Figure 6:
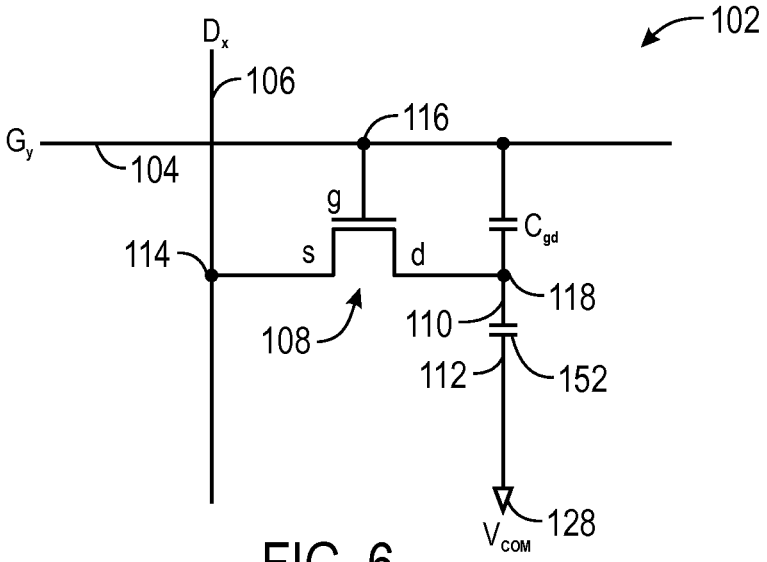
FIG. 6 is a circuit diagram of a pixel of an LCD, in accordance with an embodiment.

In an example shown in FIG. 6, within the pixel array 100, each pixel 102 stores data on the pixel electrodes 110 of the pixel. In the illustrated embodiment of FIG. 6, the pixel 102 includes the TFT 108 as previously described. The source 114 of the TFT 108 is electrically connected to the source line ($D_x$) 106 and the gate 116 of the TFT 108 is electrically connected to the gate line ($G_y$) 104. Further, the drain 118 of the TFT 108 is electrically connected to the pixel electrode 110.

Figure 7:
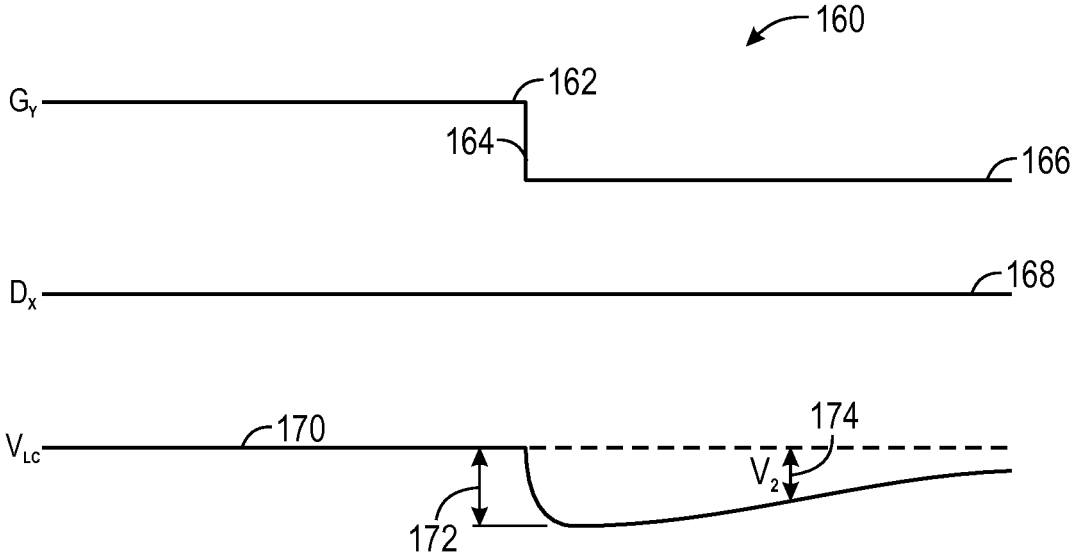
FIG. 7 is a timing diagram illustrating a kickback voltage, in accordance with an embodiment.

During operation, a data signal is supplied to the source line ($D_x$) 106 and, therefore, to the source 114 of the TFT 108. Typically, the TFT 108 includes an enhancement mode transistor that is "normally off." Thus, an activation signal is supplied to the gate line ($G_y$) 104 to activate the gate 116 of the TFT 108. With the TFT 108 activated, the data signal supplied to the source 114 flows through the TFT 108 to the drain 118. Thus, the data signal is supplied to the pixel electrode 110. To store the data signal in the pixel electrode 110, the activation signal is removed from the gate line ($G_y$) 104 while the data signal is still being supplied to the source line ($D_x$) 106. However, when the activation signal is removed, a portion of the voltage stored by the pixel electrode 110 charges the parasitic capacitance ($C_{gd}$) 152, thereby altering the voltage stored by the pixel electrode 110. The amount of voltage change by the pixel electrode 110 after the activation signal is removed is the "kickback voltage" that results in a voltage (e.g., $V_{LC}$) across the liquid crystal FIG. 7 illustrates one embodiment of a timing diagram 160 that shows the timing of the signals in the pixel 102 when the display 18 is to be turned off. The signal applied to the gate 116 (e.g., $G_y$) starts in a activated state within segment 162. At a time 164, the signal applied to the gate 116 transitions to the deactivated state throughout segment 166. In the illustrated embodiment, a signal (e.g., $D_x$) applied to the source 114 of the TFT 108 remains constant throughout the segment 168. Therefore, the signal applied to the source 114 is the same before the activation signal is supplied and after the activation signal is removed (i.e., before time 154 and after time 158, respectively). It should be noted that the signal applied to the source 114 does not necessarily need to remain at a constant level as illustrated. Specifically, the signal applied to the source 114 should be applied while the activation signal is present (i.e., while the gate 116 of the TFT 108 is activated) for a time period sufficient to cause the signal to be present on the drain 118 of the TFT 108 and to be stored in the pixel electrode 110. Further, the signal applied to the source 114 should continue to be applied until the activation signal is removed. As may be appreciated, the signal applied to the source 114 may be any suitable value that will result in a value of approximately zero volts on the pixel electrode 110. For example, the signal applied to the source 114 may be ground or vblack when the display 18 is to be shut down.

Figure 8:
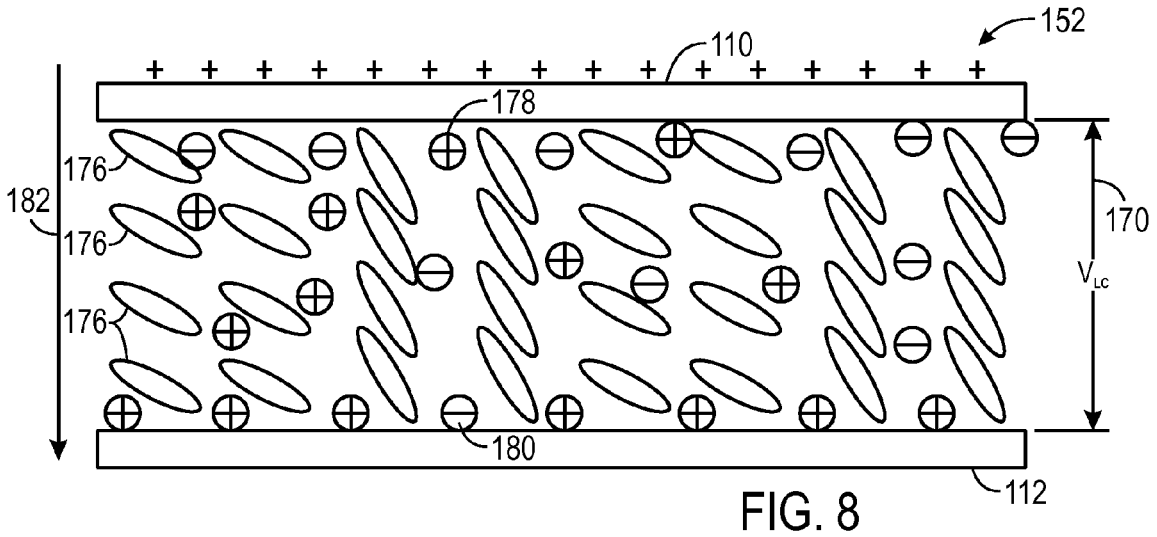
FIG. 8 is a schematic view of a liquid crystal cell that may be used in the LCD of FIG. 1, in accordance with an embodiment.

A voltage $V_{LC}$ 170 is illustrated as off while no data is being received via D. However, upon deactivation of the cell at time 164, $V_{LC}$ 170 may fluctuate some initial fluctuation voltage 172 (e.g., kickback voltage) due to accumulation the parasitic capacitance $C_{gd}$. Due to this fluctuation, when the display 18 is turned off some remaining voltage 174 may remain at the pixel electrode 110. Furthermore, because the source driver IC 120 and/or Vcom source 128 holds the Vcom at ground when the display 18 is turned off, $V_{LC}$ 170 may have some non-zero voltage across the liquid crystals 152 when the display 18 is off. As mentioned above, this non-zero voltage on the pixel electrode 110, due to kickback or other sources, may be removed by the charge removal circuitry 20 through depletion-mode transistors used as the TFTs 108 and/or through depletion-mode transistors 142. As depletion-mode transistors, the TFTs 108 and/or the transistors 142 will remain conductive when the gates of the these transistors are coupled to ground, which may occur when the display 18 is off FIG. 8 provides a schematic view of a liquid crystal cell 152. In the example of FIG. 8, the pixel electrode 110 is shown opposite the common electrode 112 to more clearly illustrate the effect of charge differences on the pixel electrode 110 and the common electrode 112 on the liquid crystal material 176. In an actual implementation, the pixel electrode 110 and the common electrode 112 may have any suitable orientation (e.g., in-plane). In any case, whether the pixel electrode 110 and the common electrode 112 are disposed opposite one another as shown in FIG. 8 or are disposed in a similar plane, a long-term electric field between the pixel electrode 110 and the common electrode 112 may, over time, affect the properties of the liquid crystal cell 152 in a similar way. That is, although the liquid crystal cell 152 shown in FIG. 8 is illustrated as having the common electrode 112 and the pixel electrode 110 located at opposite vertical ends of the liquid crystal cell 152 (e.g., as a twisted nematic liquid crystal cell), the liquid crystal cell 152 may include any other suitable arrangements with the electrodes 110 and 112 disposes in alternate locations, such as fringe-field switching (FFS) or in-plane switching (IPS) LCDs.

As illustrated in FIG. 8, the liquid crystal cell 152 includes liquid crystal material 176. The liquid crystal cell 152 also includes various positively charged ions 178 and negatively charged ions 180. As a charge is applied to the liquid crystal cell 152, an electrical field 182 is formed through the liquid crystal cell 152 that causes the liquid crystal material 176 to rotate to adjust the amount of light emitted by the display 18. As can be appreciated, the ions 178 and 180 also travel in relation to the electric field 182. For example, in the illustrated embodiment, positively charged ions 178 are attracted to a pole created by the pixel electrode 110, and negatively charged ions 180 are attracted to a pole created by the common electrode 112. When the polarity of the electric field is reversed, the ions may change direction of travel. Some ions (i.e., slow-moving ions) in the liquid crystal cell 152 may traverse the liquid crystal cell very slowly.

During operation of the display 18, inversion techniques (e.g., dot inversion, column inversions, line inversion, etc.) can be used to alternate the polarity of the electrical field 182. The slow-moving ions may generally not move over time due to alternating the polarity of the electrical field 182. However, when a $V_{LC}$ 170 remains a constant non-zero value over a substantial period of time (e.g., hours, days, weeks, or months), the slow moving ions may accumulate at opposite charged electrodes (e.g., negatively charged ions 180 at pixel electrode 110). When charged ions accumulate at opposing electrodes 110 and 112, the performance of the display 18 may be impaired. Specifically, the ions may create a voltage bias that causes a change in a balanced Vcom value that may lead to flickers, vertical/horizontal lines (e.g., mura artifacts), and/or other artifacts within the display 18. In other words, a voltage bias changes the response of the liquid crystal material 176 to a voltage difference between the electrodes 110 and 112 because the field created by the ions must be overcome by the electric field formed by the $V_{LC}$ 170. The charge removal circuitry 20 may be used to substantially remove a charge from the pixel electrode to thereby substantially remove the electrical field 182 when the display 18 is turned off.

Figure 9:
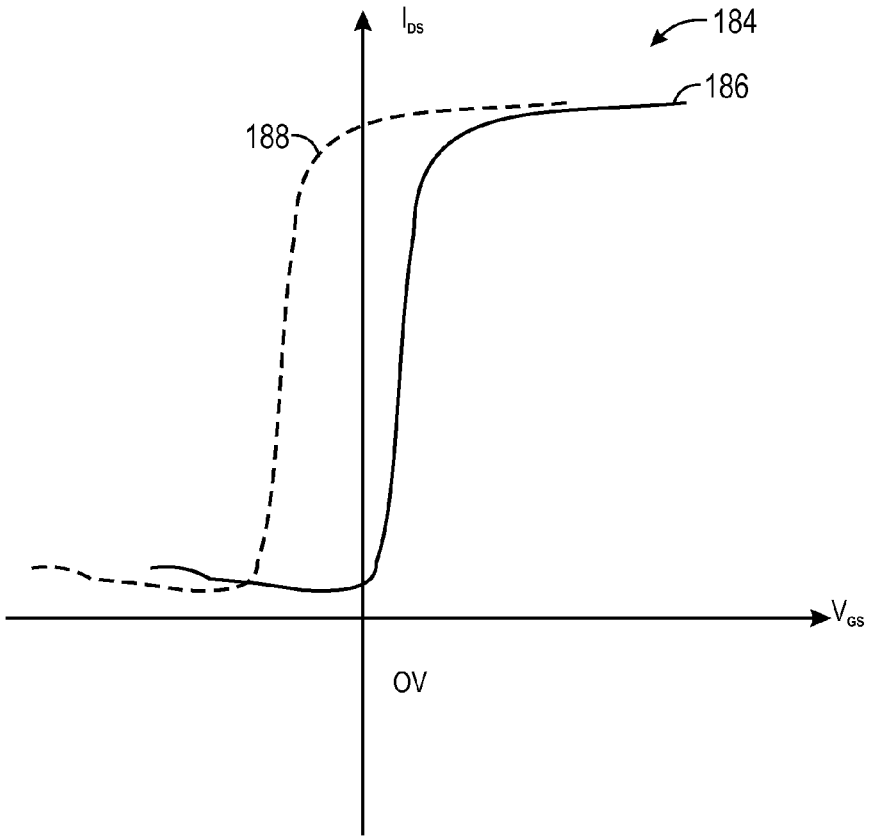
FIG. 9 is a chart view of characteristic curves of enhancement mode and depletion-mode transistors, in accordance with an embodiment.

To reduce the possibility of creation of a voltage bias within the liquid crystal cell 152, it may be desirable to reduce the $V_{LC}$ 170 by reducing the voltage difference between Vcom and the voltage at the pixel electrode 110 while the display 18 is off. One embodiment for reducing the voltage difference involves forming the display using depletion-mode transistors in the active area 103, the demultiplexer circuitry 122, and/or the charge removal circuitry 20. FIG. 9 illustrates a characteristic curve (e.g., $V_{GS}$-$I_{DS}$ curve) graph 184 for depletion-mode and enhancement mode transistors. An enhancement mode transistor is off when a voltage of 0V exists between the gate and source of the transistor, such that little to no current passes from the drain to the source of the transistor, as illustrated by an enhancement mode transistor curve 186. However, a depletion-mode transistor is on when a voltage of 0V exists between the gate and source of the transistor, such that substantial current passes from the drain to the source of the transistor, as illustrated by an depletion-mode transistor curve 188. In other words, in a display having depletion-mode transistors in the active area 103, the charge removal circuitry 20, and/or the demultiplexer circuitry 122, current may be passed from the pixels 102 to ground when the display 18 is off and the gates of the depletion-mode transistors are provided a ground voltage.

Returning to FIG. 5, the present embodiment may include depletion-mode transistors as the transistors of the charge removal circuitry 20 (e.g., transistors 142) and demultiplexer circuitry 122. Thus, when the display 18 is off and the gates of the transistors are not actively supplied with a voltage, but rather are supplied with a ground voltage, the charge removal circuitry 20 shorts all of the pixel electrodes 110 to ground via the ground lines 134 and 138. Since the Vcom source 128 holds Vcom at ground, a voltage difference between Vcom and the pixel electrode 110 (e.g., due to a kickback voltage when the display 18 is turned off) may be dissipated through the now-closed depletion-mode transistors, thereby reducing the likelihood of that a voltage bias will remain when the display 18 is off. In other words, reducing the $V_{LC}$ 170 when the display 18 is off may reduce or eliminate mura artifacts, flickering, or other artifacts. Furthermore, in the illustrated embodiment, because the demultiplexer circuitry 122 is located between the charge removal circuitry 20 and the active area 103, the demultiplexer circuitry 122 may utilize depletion-mode transistors to enable current to flow freely through the demultiplexer circuitry 122 when the display 18 is turned off.

Figure 10:
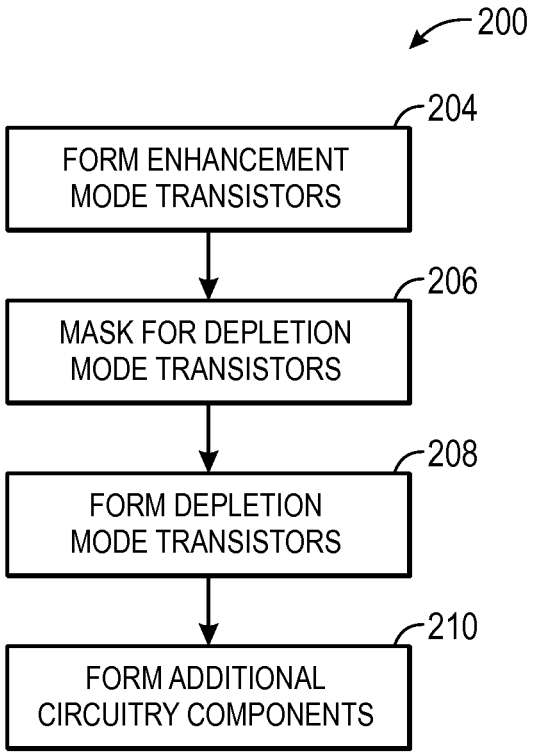
FIG. 10 is a flow chart illustrating a process for forming the display of FIG. 1, in accordance with an embodiment.

FIG. 10 illustrates a process 200 for manufacturing a display 18. When the display 18 is manufactured at least partly in accordance with the process 200, the circuitry used to dissipate charge remaining on the pixels 102 after the display 18 is turned off employs depletion-mode transistors, which may be more expensive to manufacture, but other circuitry of the display 18 may employ enhancement mode transistors, which may be less expensive to manufacture. Thus, the process 200 includes forming enhancement mode transistors for the circuitry of the display 18 (block 204). These transistors may include NPN or PNP transistors formed as metal-oxide-semiconductor field-effect transistor (MOSFETS). At least some transistors (e.g., those in the active area of the display 18) are formed as thin film transistors (TFTs). The transistors may be formed in any suitable way, such as by doping a semiconductor substrate to form either an n-type or p-type doping. Regions corresponding to drains and sources may be doped of the opposite type (e.g., p-type or n-type, respectively). The region between the source and drain of each transistor may be used to grow a layer of dielectric material (e.g., $SiO_2$) on the semiconductor substrate, and the gate, source, and drain electrodes may be deposited on the semiconductor substrate as metal or polycrystalline silicon. The source and drain may be coupled to respective doped regions and the gate may be coupled to the dielectric material. In some embodiments, the deposition of the dielectric material and the gate, source, and drain terminals may be performed after all doping of the semiconductor substrate has been performed.

Forming depletion-mode transistors may involve depositing additional material on the enhancement mode transistors that have been formed to create the depletion-mode transistors. Thus, those transistors that will remain enhancement mode transistors may be masked, as well as other regions where depletion-mode transistors are not desired (block 206). Thereafter, depletion-mode transistors may be formed for charge dispersal portions of the display (e.g., charge removal circuitry 20, the active area 103, and/or the demultiplexer circuitry 122) (block 208). Depletion-mode transistors may be formed in a manner similar to the enhancement mode transistors. However, the depletion-mode transistors may use a single doped region that is coupled to the dielectric material, the drain, and the source of the transistor. Alternatively, the doped regions of an enhancement mode transistor corresponding to the source and drain of the transistor may be connected by channel doped of the same type as the source and drain regions (e.g., p-type). In some embodiments, the source and drain regions may be doped for all drain and source regions when enhancement mode transistors are formed, but depletion-mode transistors may be subsequently formed by connecting the source and drain regions using similarly doped material. After the transistors are formed, additional circuitry components may be formed on or added to the semiconductor substrate (e.g., resistors, liquid crystal layer, trace lines, and/or terminals) (block 210).

Figure 11:
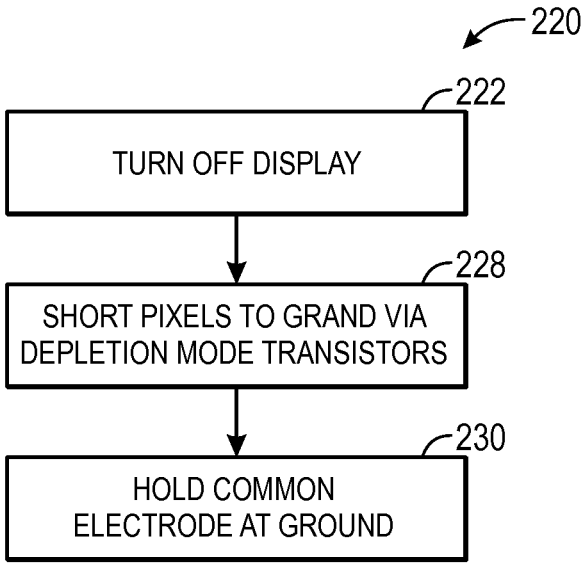
FIG. 11 is a flow chart illustrating a process of reducing a voltage across the liquid crystal cell of FIG. 8 when the LCD is turned off, in accordance with an embodiment.

FIG. 11 illustrates a process 220 that is used to turn off a display (e.g., display 18) while reducing a voltage across liquid crystal cells thereby reducing the likelihood of defects caused by a voltage bias in the liquid crystal cells. The process 220 includes turning off the display 18 (block 222). When the display 18 is turned off, depletion-mode transistors (e.g., of the active area 103, the charge removal circuitry 20, and/or the demultiplexer circuitry 122) are supplied a ground voltage and enter and/or remain in an on state. Depletion-mode transistors in demultiplexer circuitry 122 and/or the charge removal circuitry 20 short each of the pixels 102 to ground (block 228). Specifically, depletion-mode transistors in the demultiplexer circuitry 122 and the active area 103 (e.g., the TFTs 108) connect the pixels 102 to one another via the now-connected data lines, while the charge removal circuitry 20 short the data lines to ground. In other words, depletion-mode transistors are on when the display 18 is off and the gates of the depletion mode transistors of the display 18 receive a ground voltage, causing each of the pixels 102 to connect to ground. Therefore, each of the pixels 102 has a voltage difference from pixel electrode 110 to common electrode 112 of substantially ground (e.g., approximately 0V) because the Vcom (e.g., common electrodes) may also be held at ground (block 230). Accordingly, when the display 18 is turned off, the voltage across the liquid crystal cells 152 of the pixels 102 is reduced by dissipating and/or distributing kickback voltage on the pixels 102 through the connection to ground. Since the kickback voltage may be dissipated to ground, the likelihood of a voltage remaining across the liquid crystal cell 152 while the display 18 is off is reduced.

Display artifacts due to voltage biases in the liquid crystal layer 152 may be reduced accordingly.

Figure 12:
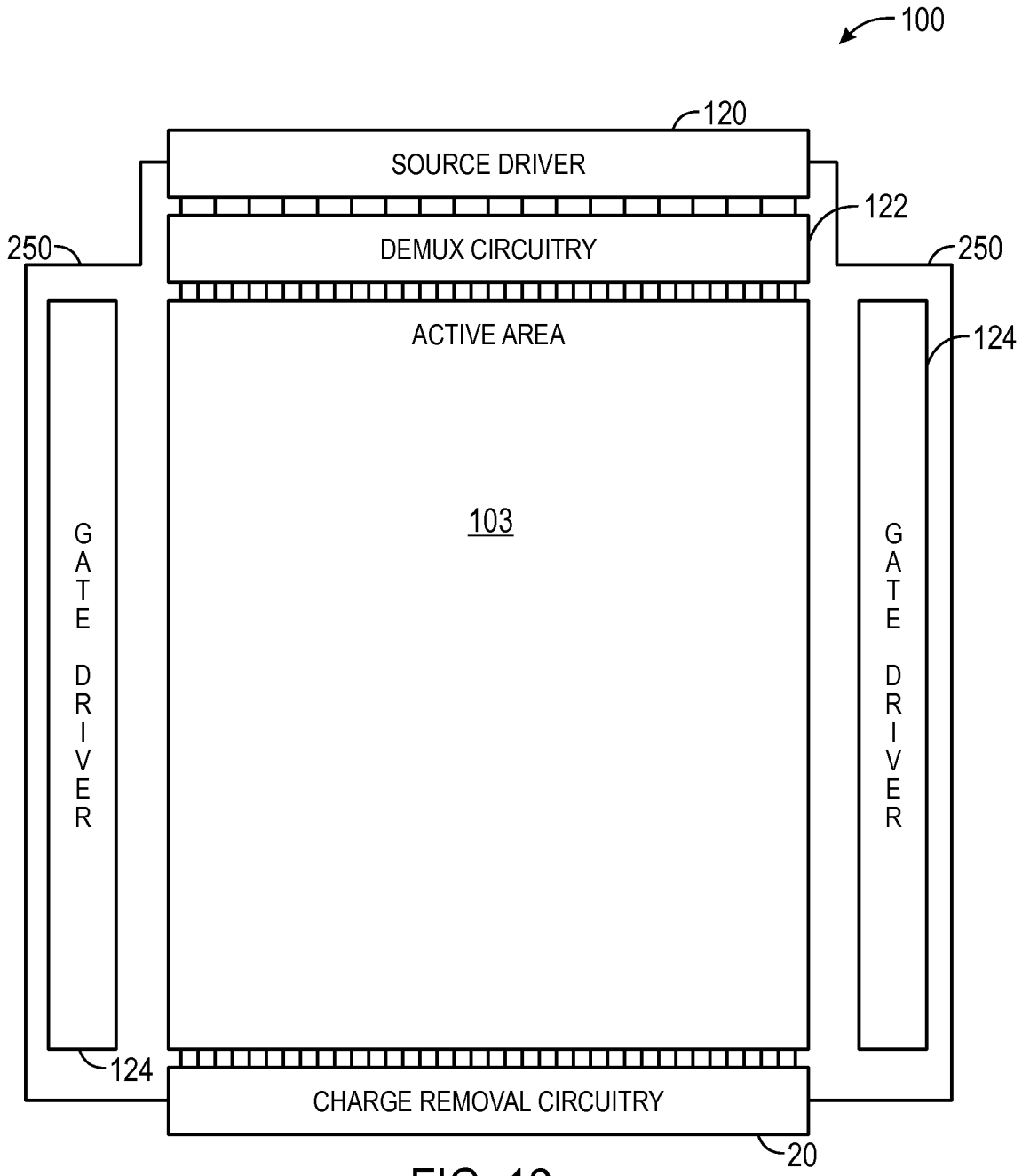
FIG. 12 is a block diagram view illustrating a pixel array arranged in an orientation alternative to FIG. 4, in accordance with an embodiment.

The process 200 of FIG. 10 and the process 220 of FIG. 11 may be generally used with additional or alternative embodiments of the display 18. In such additional or alternative embodiments, the display 18 may employ depletion-mode transistors in charge removal circuitry 20 and the active area 103, though the charge removal circuitry 20 may be located in other areas of the display 18. For instance, FIG. 12 illustrates a block diagram view of an embodiment of the pixel array 100 in such an alternative arrangement. Specifically, the charge removal circuitry 20 may be located in a region around the active area 103 apart from the demultiplexer circuitry 122. By locating the charge removal circuitry 20 remotely from the demultiplexer circuitry 122, the demultiplexer circuitry 122 may be formed using enhancement mode transistors, while the charge removal circuitry 20 and the active area 103 may be formed using depletion-mode transistors. In other words, since the charge removal circuitry 20 may be directly connected to the active area 103 via depletion mode transistors, the demultiplexer circuitry 122 may avoid serving as an intermediary between the charge removal circuitry 20 and the active area 103, and thus may use components that are off when supplied a ground voltage (e.g., enhancement mode transistors rather than depletion-mode transistors). Accordingly, the demultiplexer circuitry 122 may use less voltage when switching the switches within the demultiplexer circuitry 122 due to the threshold voltage value differences between enhancement and depletion-mode transistors and/or the display 18 may be slightly less expensive to manufacture. Because the charge removal circuitry 20 may not connect to the pixels 102 via the demultiplexer circuitry 122, the charge removal circuitry 20, may be connected to ground using traces 250, which may run around the gate drivers 124.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method for reducing visual artifacts in a display, comprising:

turning off the display; and in response to turning off the display:

connecting a pixel electrode of the pixel of the display to ground; and maintaining using a depletion-mode transistor the connection of the pixel electrode of the pixel of the display to ground while the display is off, wherein the depletion-mode transistor maintains the connection while a gate of the depletion-mode transistor is connected to ground, wherein the maintained connection is configured to reduce or eliminate a voltage difference across a liquid crystal cell of the pixel while the display is off to reduce or eliminate visual artifacts when the display is turned back on;

wherein a common electrode of the pixel of the display has a voltage of substantially ground when the display is turned off.

2. The method of claim 1, wherein connecting the pixel electrode of the pixel of the display to ground comprises:

connecting a data line coupled to the depletion-mode transistor to ground, wherein the depletion-mode transistor comprises a thin film transistor; and connecting the thin film transistor of the pixel to the data line; and wherein maintaining the connection of the pixel electrode of the pixel of the display to ground while the display is off comprises:

maintaining the connection of the data line to ground while the display is off; and maintaining the connection of the depletion-mode transistor to the data line while the display is off.

3. The method of claim 2, comprising:

connecting demultiplexer circuitry coupled to the data line to ground; and maintaining a conductivity of the demultiplexer while the display is off to maintain the connection of the data line to ground via the demultiplexer circuitry.

4. The method of claim 2, wherein the data line is connected to ground via charge removal circuitry coupled to demultiplexer circuitry coupled to the data line and wherein the connection of the data line to ground is maintained by maintaining the connection to ground through the charge removal circuitry and the demultiplexer circuitry while the display is off.

5. The method of claim 2, wherein the data line is connected to ground through charge removal circuitry coupled directly to the data line and wherein the connection of the data line to ground is maintained by maintaining the connection to ground through the charge removal circuitry while the display is off.

6. The method of claim 1, wherein connecting the pixel electrode of the pixel of the display to ground and maintaining the connection of the pixel electrode of the pixel of the display to ground while the display is off comprises connecting the pixel electrode of the pixel of the display to ground via one or more depletion-mode transistors that are active when the display is off.

7. An electronic display comprising:

a plurality of pixels, each pixel comprising:

a common electrode;

a pixel electrode;

a liquid crystal cell; and a depletion-mode transistor configured to couple the pixel electrode while a gate of the depletion-mode transistor is connected to approximately 0V;

a common voltage source configured to supply a common voltage to the common electrodes of the pixels;

a gate driver configured to supply activation signals to the pixels to activate the pixels;

a source driver configured to supply data signals to the pixel electrodes when the pixels are activated; and charge removal circuitry configured to connect each pixel electrode to ground while the electronic display is turned off, wherein the charge removal circuitry is configured to reduce or eliminate a voltage difference across the liquid crystal cells of the plurality of pixels while the display is off to reduce or eliminate visual artifacts when the display is turned back on.

8. The electronic display of claim 7, wherein the charge removal circuitry is configured to dissipate a kickback voltage occurring when the electronic display is turned off.

9. The electronic display of claim 7, wherein the charge removal circuitry comprises one or more depletion-mode transistors.

10. The electronic display of claim 7, wherein the source driver is configured to provide one or more ground connections to the pixel electrodes via the charge removal circuitry while the display is off.

11. The electronic display of claim 7, comprising demultiplexer circuitry comprising depletion-mode transistors, wherein the demultiplexer circuitry is located between the charge removal circuitry and the pixels and the demultiplexer circuitry is configured to maintain an electrical connection between the charge removal circuitry and the pixels while the display is off.

12. The electronic display of claim 7, comprising demultiplexer circuitry comprising enhancement mode transistors, wherein the charge removal circuitry is coupled directly to the data lines to enable the charge removal circuitry to connect each pixel to ground while the display is off and the demultiplexer circuitry is configured not to enable an electrical connection while the display is off.

13. The electronic display of claim 7, comprising one or more traces configured to connect the charge removal circuitry to a ground source.

14. An electronic device comprising:

an electronic display comprising:

a plurality of pixels, each pixel comprising:

a liquid crystal cell;

a pixel electrode; and a depletion-mode thin film transistor that controls access to the pixel electrode that couples the pixel electrode to ground when a gate of the depletion-mode thin film transistor is connected to a ground voltage; and charge removal circuitry comprising a plurality of depletion-mode transistors configured to connect the pixel electrodes to ground while the electronic display is turned off, wherein the charge removal circuitry is configured to reduce or eliminate a voltage difference across the liquid crystal cells of the plurality of pixels while the display is off to reduce or eliminate visual artifacts when the display is turned back on.

15. The electronic device of claim 14, wherein the charge removal circuitry is also configured to enable an integrity of the plurality of pixels to be tested during manufacture of the electronic display.

16. The electronic device of claim 14, wherein the electronic device comprises a handheld electronic device, a portable telephone, a notebook computer, a desktop computer, a media playback device, or any combination thereof.

17. A method for manufacturing an electronic display, the method comprising:

forming a plurality of enhancement mode transistors in a semiconductor substrate;

masking the first plurality of enhancement mode transistors; and forming a plurality of depletion-mode transistors in the semiconductor substrate, wherein the depletion-mode transistors are configured to couple pixel electrodes of pixels of the display to ground when gates of the depletion-mode transistors are connected to approximately 0V, wherein the depletion mode transistors are configured to reduce or eliminate a voltage difference across liquid crystal cells of the pixels of the display while the display is off to reduce or eliminate visual artifacts when the display is turned back on.

18. The method of claim 17, wherein forming the plurality of enhancement mode transistors comprises forming transistors used by demultiplexer circuitry of the electronic display.

19. The method of claim 17, wherein forming the plurality of depletion-mode transistors comprises forming transistors used by charge removal circuitry and an active area of the electronic display.

20. A pixel array of an electronic display comprising:

charge removal circuitry comprising charge removal depletion-mode transistors configured to connect to ground while the electronic display is off; and an active area of the electronic display comprises a plurality of unit pixels each having a pixel electrode, a liquid crystal cell, and a depletion-mode access transistor, wherein the depletion-mode access transistor is configured to electrically connect the pixel electrode to a data line while the electronic display is off while a gate of the depletion-mode access transistor receives a ground voltage, and wherein each data line is configured to electrically connect to ground while the electronic display is off via the charge removal depletion-mode transistors connected to ground while the electronic display is off, wherein the charge removal circuitry is configured to reduce or eliminate a voltage difference across the liquid crystal cells while the display is off to reduce or eliminate visual artifacts when the display is turned back on.

21. The pixel array of claim 20, wherein the access and charge removal depletion-mode transistors comprise thin film transistors.

22. The pixel array of claim 20, comprising demultiplexer circuitry located between the active area and the charge removal circuitry, wherein the demultiplexer circuitry comprises depletion-mode transistors that are configured to electrically connect each data line to the charge removal circuitry while the electronic display is off.

23. An electronic display comprising:

a pixel comprising:

a pixel electrode;

a liquid crystal cell; and a depletion-mode thin-film-transistor that couples the pixel electrode to ground while a gate of the depletion-mode thin-film transistor receives a ground voltage, wherein the depletion-mode thin-film transistor is configured to reduce or eliminate a voltage difference across the liquid crystal cell while the display is off to reduce or eliminate visual artifacts when the display is turned back on.

* * * * *